US006024194A

United States Patent [19]

Chung-Hsien

[11] Patent Number: 6,024,194

[45] Date of Patent: Feb. 15, 2000

[54] WHEELED CASE FOR CARRYING DOCUMENT FILE HOLDERS

[75] Inventor: Kuo Chung-Hsien, Taipei County, Taiwan

[73] Assignee: Chaw Kong Co., Ltd., Taipei, Taiwan

[21] Appl. No.: 08/985,969

[22] Filed: Dec. 5, 1997

Related U.S. Application Data

[60] Provisional application No. 60/032,553, Dec. 12, 1996.

[51] Int. Cl.[7] ..... A45C 3/00

[52] U.S. Cl. ..... 190/114; 190/18 A; 190/115

[58] Field of Search ..... 190/18 A, 115, 190/121, 114; 280/37; 16/115

[56] References Cited

U.S. PATENT DOCUMENTS 4,527,677 7/1985 March et al. ..... 190/114 X
5,435,423 7/1995 Reduc et al. ..... 190/114 X
5,762,170 6/1998 Shyr et al. ..... 190/114 X

*Primary Examiner*—Gary E. Elkins
*Assistant Examiner*—Tri M. Mai
*Attorney, Agent, or Firm*—Winston Hsu

[57] ABSTRACT

A wheeled case for holding document file holders is disclosed. The wheeled case comprises a substantially rectangular case body having a front opening, two front covers flexibly connected to the front opening for covering the front opening, two front cover fastener installed over the two front covers for closing the front covers, a pull handle assembly having two sliding tubes and a U-shaped pull handle vertically installed in the case body near the front opening, two hanging rods horizontally installed over the sliding tubes for hanging the two pairs of hanging hooks of each of the document file holders wherein the two pairs of hanging hooks of each of the document file folders are hanged over the upper and lower hanging rods separately and restricted between the front covers and the two hanging rods when the front covers are closed by using the front cover fasteners.

9 Claims, 5 Drawing Sheets

WHEELED CASE FOR CARRYING DOCUMENT FILE HOLDERS

This application claims benefits of Provisional Appln 60/032,553 filed Dec. 12, 1996.

BACKGROUND OF THE INVENTION

1. Field of the Invention

This invention relates to a wheeled case, and more particularly, to a wheeled case for carrying document file holders.

2. Description of the Prior Art

Document file holders are commonly used in an office environment for holding document papers or files. A document file holder usually comprises two pairs of hanging hooks which are used for hanging the document file holder over a pair of hanging rods installed within a drawer. Since each document file holder contains hanging hooks on its outer sides, it is difficult to move such document file holders by hands if they are not properly packed. Portability of document file holders is thus greatly suffered.

But document file holders are a good tool for storing various document papers and files. If a container with wheels can be built to keep such document file holders, portability of such document file holders can greatly be enhanced, and a user can thus easily carry a lot of document file holders and conveniently use these document file holders.

SUMMARY OF THE INVENTION

It is therefore an objective of the present invention to provide a wheeled case for carrying document file holders.

In a preferred embodiment, the present invention includes a wheeled case for carrying document file holders each having two pairs of hanging hooks comprising:

(1) a substantially rectangular and rigid case body having a top panel, a bottom panel, a rear panel, a left panel, a right panel, a front opening having four edges defined by the top, bottom, left and right panels of the case, and a front cover means flexibly connected to at least one edge of the front opening for covering the front opening of the case;

(2) front cover fastening means for releasably fastening the front cover means to close the front opening of the case;

(3) a pull handle assembly comprising:

(a) two sliding tubes each having an upper end and a lower end; and (b) a U-shaped handle having a gripping handle and two rods slidingly and vertically received within the two sliding tubes through the upper ends of the two sliding tubes;

(4) an upper fastening means for fixing the upper ends of the two sliding tubes inside the front opening and an lower fastening means for fixing the lower ends of the two sliding tubes inside the front opening wherein the upper and lower ends of the sliding tubes are vertically fixed between the top and bottom panels of the case body near the front opening;

(5) upper and lower hanging rods for hanging the two pairs of hanging hooks of each of the document file holders, each hanging rod comprising two ends;

(6) upper rod mounting means for horizontally mounting the two ends of the upper hanging rod to the upper ends of the two sliding tubes; and (7) lower rod mounting means for horizontally mounting the two ends of the upper hanging rod to the two sliding tubes near the top panel;

wherein the two pairs of hanging hooks of each of the document file folders are hanged over the upper and lower hanging rods separately and restricted between the front cover means and the upper and lower hanging rods when the front cover means is fastened to the front opening by using the front cover fastening means.

It is an advantage of the present invention that it provides a wheeled case for carrying document file holders.

These and other objects and the advantages of the present invention will no doubt become obvious to those of ordinary skill in the art after having read the following detailed description of the preferred embodiment which is illustrated in the various figures and drawings.

DETAILED DESCRIPTION OF THE PREFERRED EMBODIMENT

Figure 2:
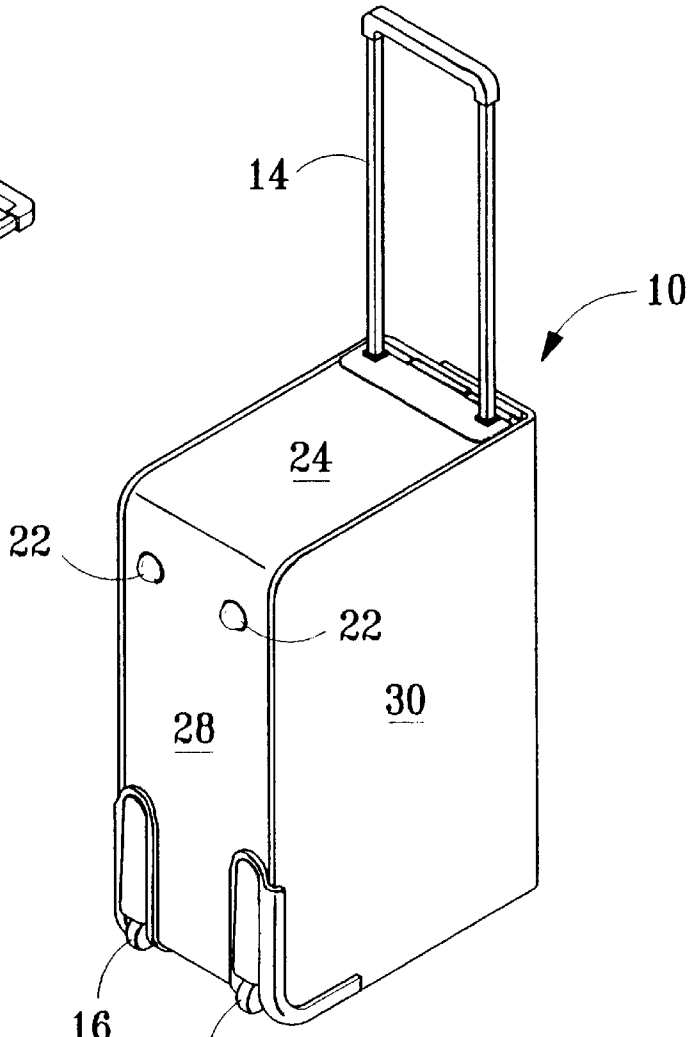
FIG. 2 is another perspective view of the wheeled case shown in FIG. 1.
Figure 1:
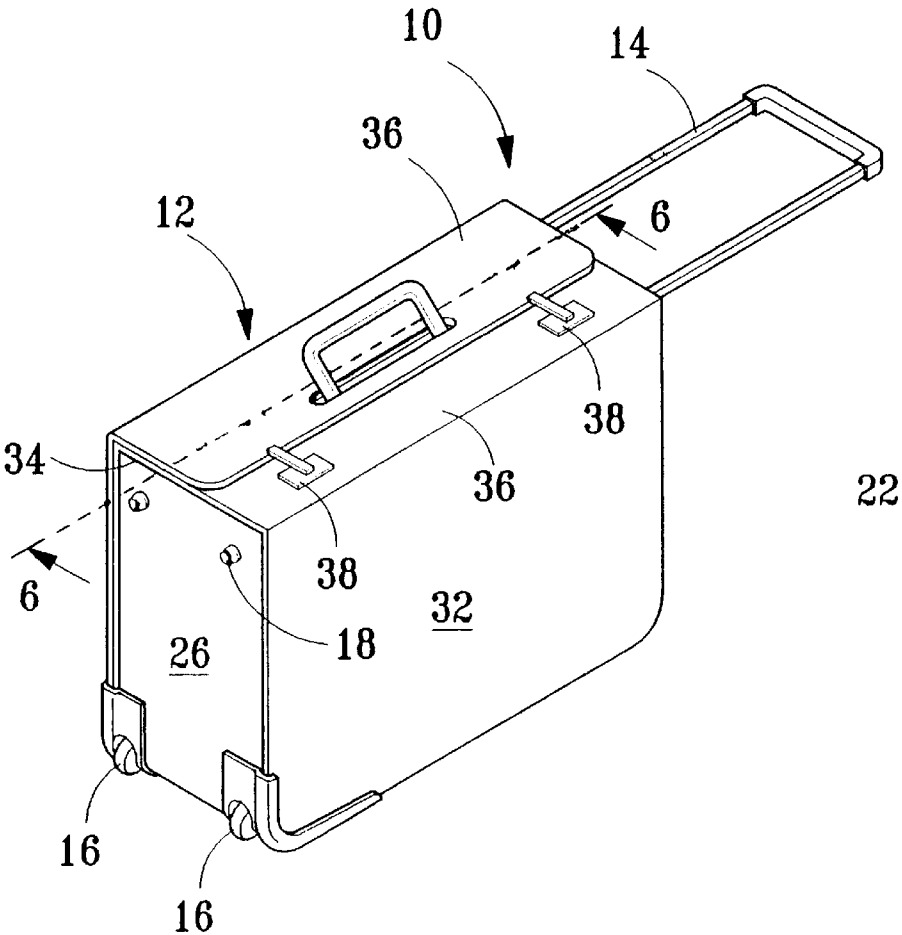
FIG. 1 is a perspective view of a wheeled case according to the present invention.
Figure 3:
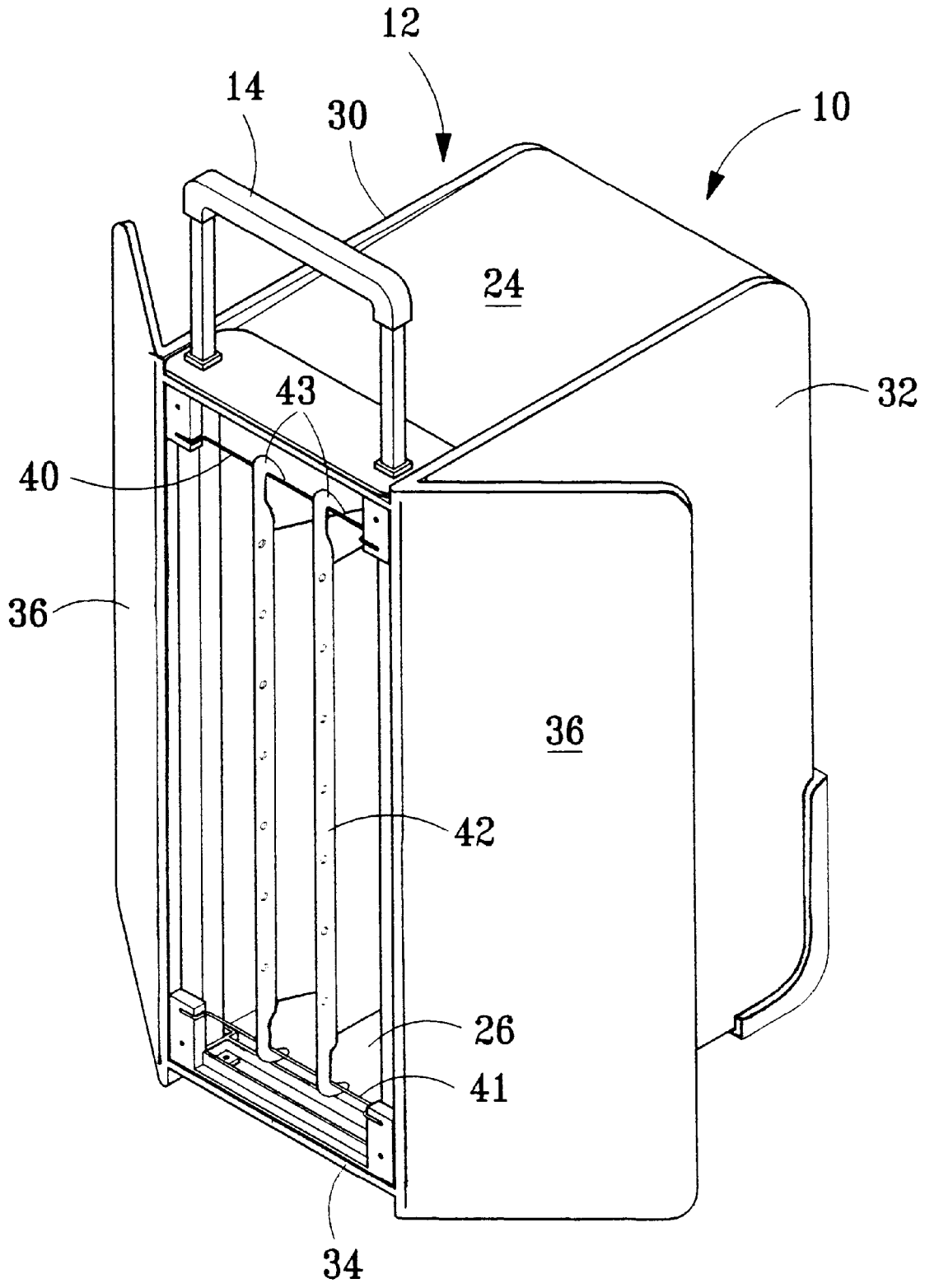
FIG. 3 is a perspective view of the wheeled case shown in FIG. 1 with its front covers opened.

Please refer to FIGS. 1 to 3. FIG. 1 is a perspective view of a wheeled case 10 which is in a horizontal position. FIG. 2 is another perspective view of the case 10 which is in a vertical position. And FIG. 3 is a perspective view of the case 10 with its front covers 36 opened.

Case 10 comprises a substantially rectangular and rigid case body 12 having a front opening 34 and two front covers 36 flexible connected to two edges of the front opening 34 for closing its front opening 34, two front cover fasteners 38 installed over the two front covers 36 for releasably fastening the front covers 36 together to close the front opening 34, a pull handle assembly 14 vertically installed inside the case body 12 near its front opening 34 for pulling the case 10 forward or backward, two hanging rods 40 and 41 horizontally installed over the pull handle assembly 14 inside the case body 12 for hanging the two pairs of hooks 43 of the document file holders 42, two wheels 16 installed over the rear bottom end of the case body 12 for supporting the case body 26 when the case 10 is moved by using the pull handle assembly 14, two flexible bottom bumpers 18 installed over the front bottom end of the case body 12 for protecting the bottom end of the case body 12 when case 10 is in a vertical position (see FIG. 2), and two rear bumpers 22 installed over the rear upper end of the case body 12 for protecting the rear end of the case body 12 when case 10 is in a horizontal position (see FIG. 1).

The case body 12 comprises a top panel 24, a bottom panel 26, a rear panel 28, a left panel 30, a right panel 32, a front opening 34 having four edges defined by the top, bottom, left and right panels of the case 10, and two front covers 36 flexibly connected to the edges of the left panel 30 and right panel 32 of the front opening 34 for covering the front opening 34 of the case 10. All these panels of the case body 12 are made by rigid material such as hard paper boards or plastic boards. And all the boards except the front covers 36 of the case body 12 are fixedly bounded together. The case body 12 plus the pull handle assembly 14 and the wheels 36 are used as the major supporting structure of the case 10 for supporting all the document file folders 42 loaded inside.

Outside the case body 12, the two corner wheels 16 are fastened to the rear panel 28 and bottom panel 26 of the case body 12. The bottom bumpers 18 are installed over the front end of the bottom panel 26 and the two rear bumpers 22 are installed over the rear upper end of the rear panel.

Figure 4:
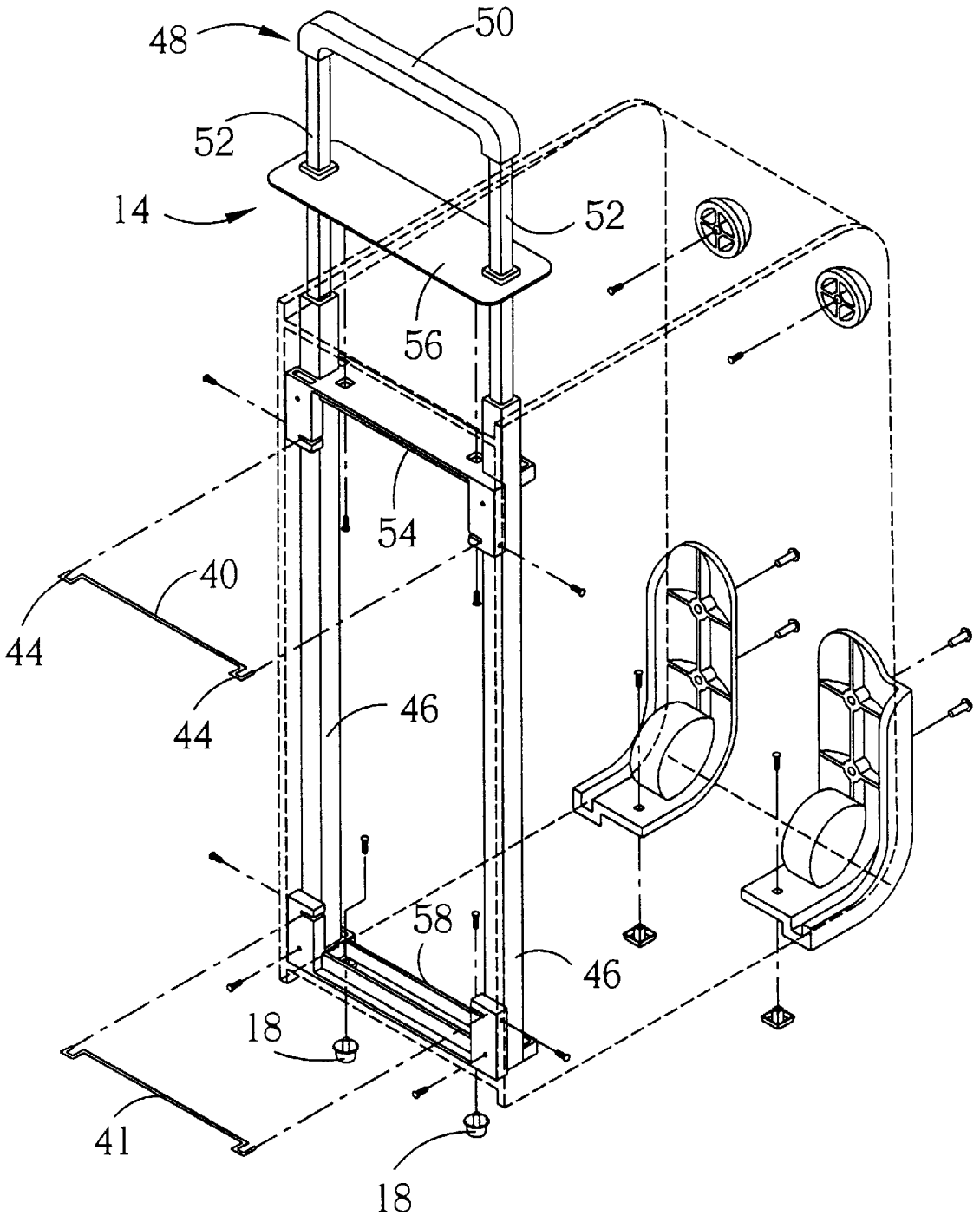
FIG. 4 is a part assembly diagram of the wheeled case shown in FIG. 1.
Figure 5:
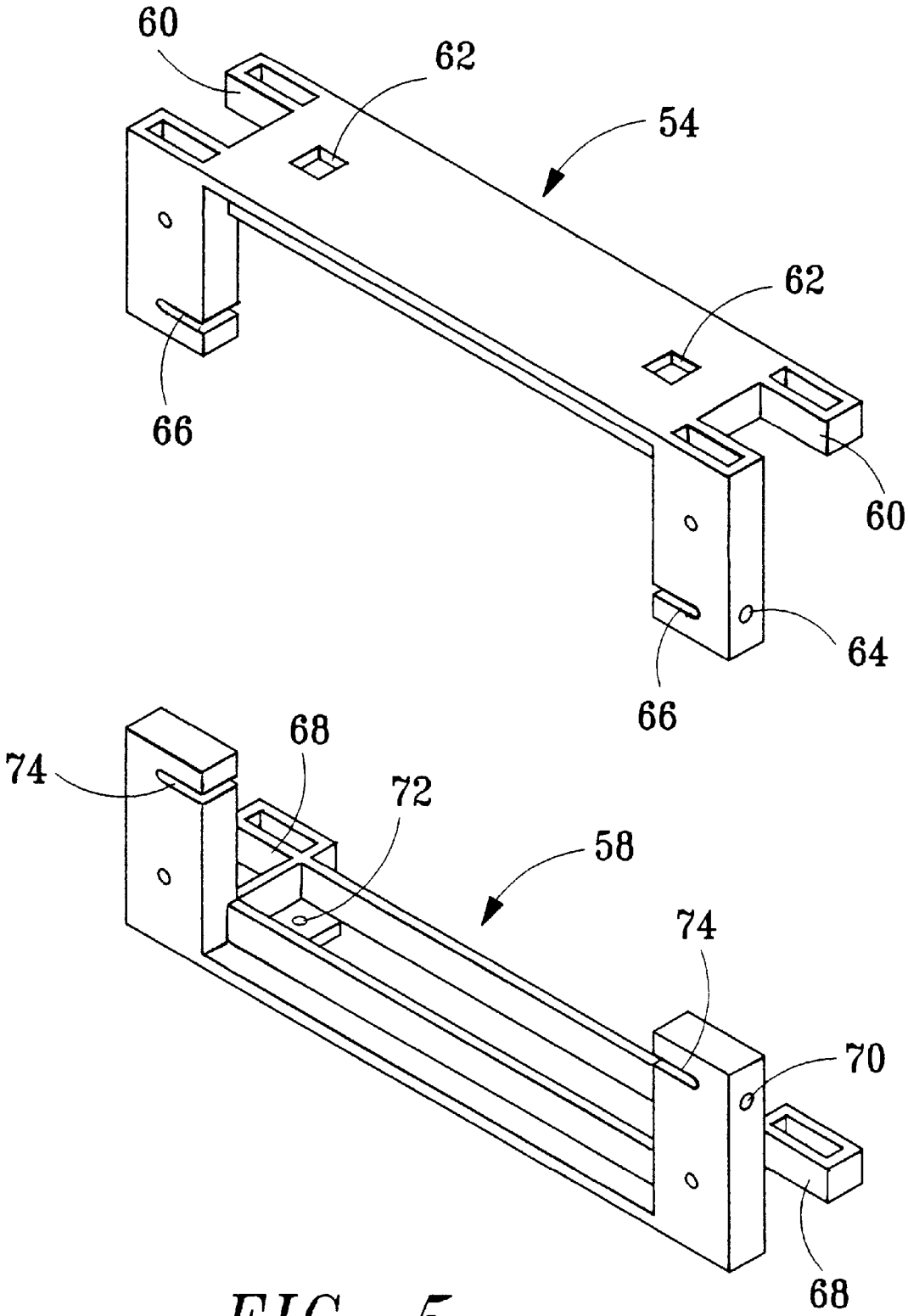
FIG. 5 is a perspective view of the upper and lower base units shown in FIG. 4.

Please refer to FIGS. 4 and 5. FIG. 4 is a part assembly diagram of the case 10. And FIG. 5 is a perspective view of the upper base unit 54 and lower base unit 58 shown in FIG. 4. FIG. 4 shows that the pull handle assembly 14 comprises two sliding tubes 46 each having an upper end and a lower end, and a U-shaped handle 48 having a gripping handle 50 and two rods 52 slidingly received within the two sliding tubes 46 through the upper ends of the two sliding tubes 46.

The case 10 further comprises an upper fastener which comprises an upper base unit 54 and an external plate 56, is used for fixing the upper ends of the two sliding tubes 46 inside the upper end of the front opening 34, and an lower fastener which comprises a lower base unit 58 and the two bottom bumpers 18, for fixing the lower ends of the two sliding tubes 46 inside the lower end of the front opening 34 wherein the upper and lower ends of the sliding tubes 46 are vertically fixed between the top panel 24 and bottom panel 26 of the case body 12 near the front opening 34.

The upper base unit 54 shown in FIG. 5 comprises two U-shaped ends 60 for engaging the upper ends of the two sliding tubes 46 and two screw mounting holes 62 for fastening the external plate 56. When the upper base unit 54 and the external plate 56 are fastened together by using screws, the top panel 24 is clamped in between. Each of the two U-shaped ends 60 of the upper base unit 54 comprises a screw mounting hole for fastening the two U-shaped ends 60 to the left panel 30 and right panel 32 separately by using screws and a recess 66 for horizontally mounting the two ends 44 of the upper hanging rod 40 to the upper ends of the two sliding tubes 46.

The structure of the lower base unit 54 shown in FIG. 5 is the same as the upper base unit 54. It comprises two U-shaped ends 68 for engaging the lower ends of the two sliding tubes 46 and two screw mounting holes 72 for fastening the external plate 56. When the lower base unit 58 and the bottom bumper 18 are fastened together by using screws, the bottom panel 26 is clamped in between. Each of the two U-shaped ends 68 of the lower base unit 58 comprises a screw mounting hole 70 for fastening the two U-shaped ends 68 to the left panel 30 and right panel 32 separately by using screws and a recess 74 for horizontally mounting the two ends 44 of the lower hanging rod 41 to the lower ends of the two sliding tubes 46.

Figure 6:
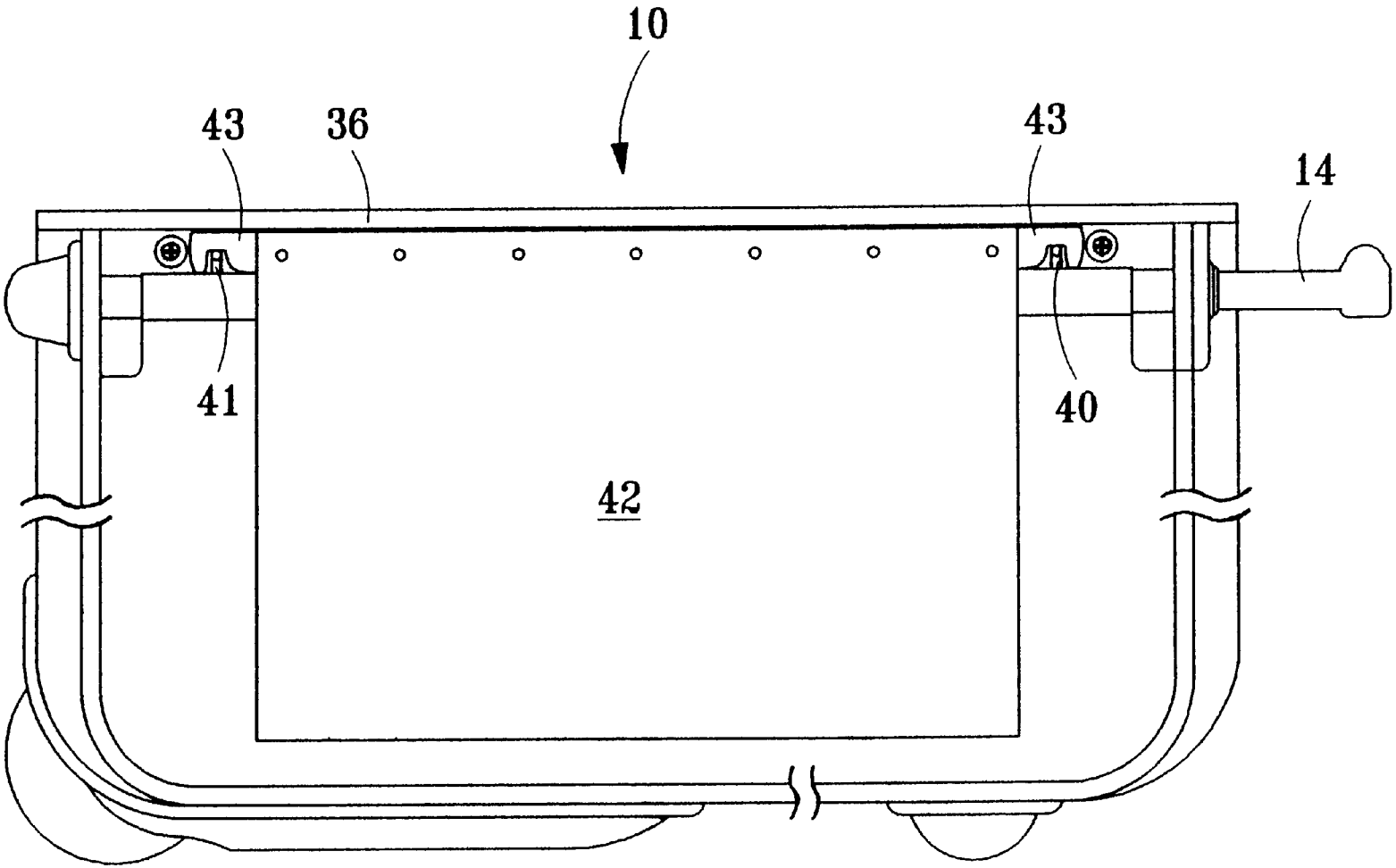
FIG. 6 is a side sectional view 6—6 of the wheeled case shown in FIG. 1.

FIG. 6 is a side sectional view 6—6 of the case 10 shown in FIG. 1. It shows that the two pairs of hooks 43 of the document file holder 42 are hanged over the upper and lower hanging rods 40 and 41 separately. Each pair of the hooks 43 are restricted between the front covers 36 and the two hanging rods 40 and 41 when the front covers 36 are fastened to the front opening 34 by using the two front cover fasteners 38.

The above disclosure is not intended as limiting. Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A wheeled case for carrying document file holders each having two pairs of hanging hooks comprising:

(1) a substantially rectangular and rigid case body having a top panel, a bottom panel, a rear panel, a left panel, a right panel, a front opening having four edges defined by the top, bottom, left and right panels of the case, and a front cover means flexibly connected to at least one edge of the front opening for covering the front opening of the case;

(2) front cover fastening means for releasably fastening the front cover means to close the front opening of the case;

(3) a pull handle assembly comprising:

(a) two sliding tubes each having an upper end and a lower end; and (b) a U-shaped handle having a gripping handle and two rods slidingly and vertically received within the two sliding tubes through the upper ends of the two sliding tubes;

(4) an upper fastening means for fixing the upper ends of the two sliding tubes inside the front opening and an lower fastening means for fixing the lower ends of the two sliding tubes inside the front opening wherein the upper and lower ends of the sliding tubes are vertically fixed between the top and bottom panels of the case body near the front opening;

(5) upper and lower hanging rods for hanging the two pairs of hanging hooks of each of the document file holders, each hanging rod comprising two ends;

(6) upper rod mounting means for horizontally mounting the two ends of the upper hanging rod to the upper ends of the two sliding tubes; and (7) lower rod mounting means for horizontally mounting the two ends of the upper hanging rod to the two sliding tubes near the top panel;

wherein the two pairs of hanging hooks of each of the document file folders are hanged over the upper and lower hanging rods separately and restricted between the front cover means and the upper and lower hanging rods when the front cover means is fastened to the front opening by using the front cover fastening means.

2. A wheeled case of claim 1 wherein said upper fastening means comprises an upper base unit having two U-shaped ends for engaging the upper ends of the two sliding tubes and an external plate wherein the upper base unit and the external plate are fastened together with the top panel clamped in between.

3. A wheeled case of claim 2 wherein the two U-shaped ends of the upper base unit are fastened to the left and right panels separately.

4. A wheeled case of claim 2 wherein the upper rod mounting means is installed over the two U-shaped ends of the upper base unit for horizontally fixing the two ends of the upper hanging rod to the upper ends of the two sliding tubes.

5. A wheeled case of claim 1 wherein said lower fastening means comprises a lower base unit having two U-shaped ends for engaging the lower ends of the two sliding tubes and two bumpers wherein the lower base unit and the two bumpers are fastened together with the bottom panel clamped in between.

6. A wheeled case of claim 5 wherein the two U-shaped ends of the lower base unit are fastened to the left and right panels separately.

7. A wheeled case of claim 5 wherein the lower rod mounting means is installed over the two U-shaped ends of the upper base unit for horizontally fixing the two ends of the lower hanging rod to the lower ends of the two sliding tubes.

8. A wheeled case of claim 1 further comprising two corner wheels wherein each of the corner wheels is fastened to the rear and bottom panels of the case body for supporting the case body when the wheeled case is moved by using the pull handle assembly.

9. A wheeled case for carrying document file holders each having two pairs of hanging hooks comprising:

(1) a substantially rectangular and rigid case body having a top panel, a bottom panel, a rear panel, a left panel, a right panel, a front opening having four edges defined by the top, bottom, left and right panels of the case, and a front cover means flexibly connected to at least one edge of the front opening for closing the front opening;

(2) a pull handle assembly comprising:

(a) two sliding tubes each having an upper end and a lower end; and (b) a U-shaped handle having a gripping handle and two rods slidingly and vertically received within the two sliding tubes through the upper ends of the two sliding tubes;

(3) means for vertically mounting the upper and lower ends of the two sliding tubes inside the case body near the front opening;

(4) upper and lower hanging rods for hanging the two pairs of hanging hooks of each of the document file holders, each hanging rod comprising two ends and being horizontally mounted over the upper two ends and the lower two ends of the sliding tubes separately;

wherein the two pairs of hanging hooks of each of the document file folders are hanged over the upper and lower hanging rods separately and restricted between the front cover means and the upper and lower hanging rods when the front cover means is fastened to the front opening by using the front cover fastening means.

* * * * *